US010767419B2

(12) United States Patent
Sigurdson

(10) Patent No.: US 10,767,419 B2
(45) Date of Patent: Sep. 8, 2020

(54) APPARATUS AND METHODS FOR HANDLING DRILL STRING

(71) Applicant: David Wyeth Sigurdson, Fort St. John (CA)

(72) Inventor: David Wyeth Sigurdson, Fort St. John (CA)

( * ) Notice: Subject to any disclaimer, the term of this patent is extended or adjusted under 35 U.S.C. 154(b) by 134 days.

(21) Appl. No.: 16/037,967

(22) Filed: Jul. 17, 2018

(65) Prior Publication Data

US 2020/0024919 A1 Jan. 23, 2020

(51) Int. Cl.

| | |
|---|---|
| ***E21B 19/02*** | (2006.01) |
| ***E21B 19/084*** | (2006.01) |
| ***E21B 7/20*** | (2006.01) |
| *E21B 23/14* | (2006.01) |

(52) U.S. Cl.

CPC ..... *E21B 7/20* (2013.01); *E21B 19/02* (2013.01); *E21B 19/084* (2013.01); *E21B 23/14* (2013.01)

(58) Field of Classification Search

CPC ..... E21B 19/02; E21B 19/084; E21B 7/20; E21B 17/20

See application file for complete search history.

(56) References Cited

U.S. PATENT DOCUMENTS

| | | | | |
|---|---|---|---|---|
| 3,275,300 | A * | 9/1966 | Delacour | E21B 19/22 254/265 |
| 4,125,162 | A | 11/1978 | Groves, Sr. et al. | |
| 4,523,645 | A * | 6/1985 | Moore | E21B 19/22 166/385 |
| 4,751,969 | A | 6/1988 | Klaeger | |
| 6,148,925 | A | 11/2000 | Moore | |
| 6,533,040 | B2 | 3/2003 | Gondouin | |
| 9,316,069 | B2 | 4/2016 | Zhang et al. | |
| 2014/0014354 | A1 | 1/2014 | Nellessen | |
| 2015/0167411 | A1 | 6/2015 | Sherman | |
| 2016/0175906 | A1 | 6/2016 | Butler | |

* cited by examiner

*Primary Examiner* — D. Andrews
(74) *Attorney, Agent, or Firm* — Todd A. Rattray; Oyen Wiggs Green & Mutala LLP

(57) ABSTRACT

An apparatus and method for pulling a drill string out from a wellbore and lowering the drill string back into the wellbore, with minimal or no disassembly of the drill string, are provided. The apparatus has a first tension mechanism, a second tension mechanism, an up-hole cable, a down-hole cable and a guide. To pull a drill string out from a wellbore, the up-hole cable is connected to an up-hole end of the drill string and the drill string is pulled upwardly into and through the guide. To lower the drill string into the wellbore, the down-hole cable is connected to the mid-section (and/or the up-hole end) of the drill string and the drill string is pulled downwardly from the guide back into the wellbore.

18 Claims, 10 Drawing Sheets

APPARATUS AND METHODS FOR HANDLING DRILL STRING

TECHNICAL FIELD

The present disclosure relates to an apparatus and method for handling a drill string. The present disclosure relates to an apparatus and method for tripping a drill string—i.e. withdrawing a drill string out from a wellbore and lowering the drill string back into the wellbore. Particular embodiments permit tripping the drill string with minimal or no disassembly of the drill string.

BACKGROUND

In the oil and gas industry, drill strings are used to drill into the earth and form wellbores. A drill string is made up of pipe sections (often referred to as pipes) connected end to end. At times, the entire drill string needs to be pulled out from a wellbore, e.g. for servicing and/or repair. Such operations may require a large number of connected pipe sections to be disconnected as the drill string is withdrawn from the wellbore and re-connected when the drill string is re-inserted into the wellbore. The disconnection and subsequent connection of these pipe sections can be time consuming, expensive and dangerous.

There is a general desire for an improved apparatus and method for handling a drill string. There is a general desire for an apparatus and method for withdrawing a drill string out from a wellbore and lowering the drill string back into the wellbore. There is a general desire to withdraw a drill string from a wellbore and to reinsert the drill string into the wellbore with minimal or no drill string disassembly, except possibly to repair a portion of the drill string.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the present disclosure provides an apparatus for handling a drill string having an up-hole end, a mid-section and a down-hole end. The apparatus comprises: a first tension mechanism; a second tension mechanism; an up-hole cable operably connectable between the first tension mechanism and the up-hole end of the drill string; a down-hole cable operably connectable between the second tension mechanism and a connection location in the mid-section of the drill string; and a guide defining an elongated channel for receiving the drill string. The guide is located relative to the first tension mechanism, the second tension mechanism, the up-hole cable and the down-hole cable, so that force applied to the up-hole end of the drill string by the first tension mechanism via the up-hole cable pulls the drill string upwardly through the elongated channel and outwardly from a wellbore and force applied to the mid-section of the drill string by the second tension mechanism via the down-hole cable pulls the drill string downwardly through the elongated channel to facilitate at least partial re-insertion of the drill string into the wellbore.

The guide may be shaped to prevent the drill string from bending, as the drill string is pulled through the elongated channel, in a manner that is sharper a minimum threshold radius of curvature for the drill string.

Force applied to the mid-section of the drill string by the second tension mechanism via the down-hole cable pulls the drill string downwardly through the elongated channel to facilitate at least partial re-insertion of the drill string into the wellbore. During such reinsertion of the drill string into the wellbore: at a release configuration where at least an up-hole portion of the drill string is located in the guide and at least a down-hole portion of the drill string is located in the wellbore, at least one of: the second tension mechanism may be disconnected from the down-hole cable; and the down-hole cable may be disconnected from the drill string; and gravity may facilitate further downward withdrawal of the drill string through the elongated channel and further insertion of the drill string into the wellbore.

The release configuration may occur when a length of the down-hole cable between the second tension mechanism and the connection location is a minimum. The release configuration may occur when a force of gravity that tends to pull the drill string back into the wellbore becomes greater than frictional forces that tend to hold the drill string in the guide. The release configuration may occur immediately prior to the connection location entering the wellbore.

For at least a portion of the time during application of force to the mid-section of the drill string by the second tension mechanism via the down-hole cable to pull the drill string downwardly through the elongated channel to facilitate at least partial re-insertion of the drill string into the wellbore, the first tension mechanism via the up-hole cable may be operative to exert upwardly oriented force on the drill string which tends to prevent the drill string from falling back into the wellbore under the force of gravity.

After disconnection of at least one of: the second tension mechanism from the down-hole cable, and the down-hole cable from the drill string, the first tension mechanism via the up-hole cable may be operative to exert upwardly oriented force on the drill string, which tends to prevent the drill string from falling back into the wellbore under the force of gravity. An amount of upwardly oriented force exerted on the drill string by the first tension mechanism via the up-hole cable may be controlled to control a rate at which the drill string extends back into the wellbore.

The guide may comprise: a tail end through which the drill string enters the guide as the drill string is removed from the wellbore and pulled upwardly into the guide by the first tension mechanism via the up-hole cable; and a corresponding tail section that is relatively more proximate to the tail end than a remainder of the guide. The tail section may be moveable relative to the remainder of the guide between: a lowered configuration where the tail section and the remainder of the guide provide the elongated channel with a smooth shape; and a raised configuration where the tail end introduces a discontinuity into a shape of the elongated channel.

The guide may comprise: a tail end through which the drill string enters the guide as the drill string is removed from the wellbore and pulled upwardly into the guide by the first tension mechanism via the up-hole cable; and a corresponding tail section that is relatively more proximate to the tail end than a remainder of the guide. At least a portion of the tail section may be shaped to provide the elongated channel with an enclosed shape, the enclosed shape surrounding a transverse cross-section of the drill string located in the elongated channel at the at least a portion of the tail section. At least a portion of the remainder of the guide may be shaped to provide the elongated channel with an open shape, the open shape surrounding only a portion of a transverse cross-section of the drill string located in the elongated channel at the at least a portion of the remainder of the guide.

The at least a portion of the tail section may comprise a moveable cover that may be moveable between a closed configuration that provides the at least a portion of the tail section with the enclosed shape and an open configuration that provides the at least a portion of the tail section with an open shape which surrounds only a portion of the transverse cross-section of the drill string located in the elongated channel at the at least a portion of the tail section.

Another aspect of the invention provides a method for handling a drill string having an up-hole end, a mid-section and a down-hole end. The method comprises pulling a drill string out from a wellbore. Pulling the drill string out from the wellbore comprises: releasably connecting an up-hole cable between a first tension mechanism and the up-hole end of the drill string; and pulling the up-hole cable and the drill string upwardly into a guide. The method comprises lowering the drill string from the guide back into the wellbore. Lowering the drill string from the guide back into the wellbore comprises: releasably connecting a down-hole cable between a second tension mechanism and a connection location in the mid-section of the drill string; pulling the down-hole cable and the drill string downwardly out from the guide to facilitate at least partially re-inserting the drill string into the wellbore; at a release configuration, where at least an up-hole portion of the drill string is located in the guide and at least a down-hole portion of the drill string is located in the wellbore, disconnecting at least one of: the second tension mechanism from the down-hole cable; and the down-hole cable from the drill string; and after the disconnecting, permitting gravity to pull the drill string further downwardly out from the guide to facilitate further re-inserting the drill string into the wellbore.

Pulling the up-hole cable and the drill string upwardly into the guide may comprise pulling at least a portion of the drill string through an elongated channel defined by the guide. The guide may be shaped to prevent the drill string from bending, as the drill string is pulled through the elongated channel, in a manner that is sharper than a minimum threshold radius of curvature for the drill string.

The release configuration may occur when a length of the down-hole cable between the second tension mechanism and the connection location is a minimum. The release configuration may occur when a force of gravity that tends to pull the drill string back into the wellbore becomes greater than frictional forces that tend to hold the drill string in the guide. The release configuration may occur immediately prior to the connection location entering the wellbore.

For at least a portion of the time during lowering the drill string from the guide back into the wellbore, the method may involve applying upward force to the up-hole end of the drill string using the first tension mechanism via the up-hole cable wherein the upward force tends to prevent the drill string from falling back into the wellbore under the force of gravity.

After disconnecting at least one of: the second tension mechanism from the down-hole cable, and the down-hole cable from the drill string, the method may involve applying upward force to the up-hole end of the drill string using the first tension mechanism via the up-hole cable wherein the upward force tends to prevent the drill string from falling back into the wellbore under the force of gravity. The method may comprise controlling an amount of the upward force exerted on the drill string by the first tension mechanism via the up-hole cable to control a rate at which the drill string extends back into the wellbore.

The guide may comprise: a tail end through which the drill string enters the guide as the drill string is pulled upwardly into the guide; and a corresponding tail section that is relatively more proximate to the tail end than a remainder of the guide. The method may further comprise moving the tail section relative to the remainder of the guide between: a lowered configuration where the tail section and the remainder of the guide provide an elongated drill-string receiving channel of the guide with a smooth shape; and a raised configuration where the tail end introduces a discontinuity into a shape of the elongated channel.

At least a portion of the tail section may be shaped to provide the elongated channel with an enclosed shape, the enclosed shape surrounding a transverse cross-section of the drill string located in the elongated channel at the at least a portion of the tail section. At least a portion of the remainder of the guide may be shaped to provide the elongated channel with an open shape, the open shape surrounding only a portion of a transverse cross-section of the drill string located in the elongated channel at the at least a portion of the remainder of the guide. The at least a portion of the tail section may comprise a moveable cover and the method may comprise moving the moveable cover between a closed configuration that provides the at least a portion of the tail section with the enclosed shape and an open configuration that provides the at least a portion of the tail section with an open shape which surrounds only a portion of the transverse cross-section of the drill string located in the elongated channel at the at least a portion of the tail section.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
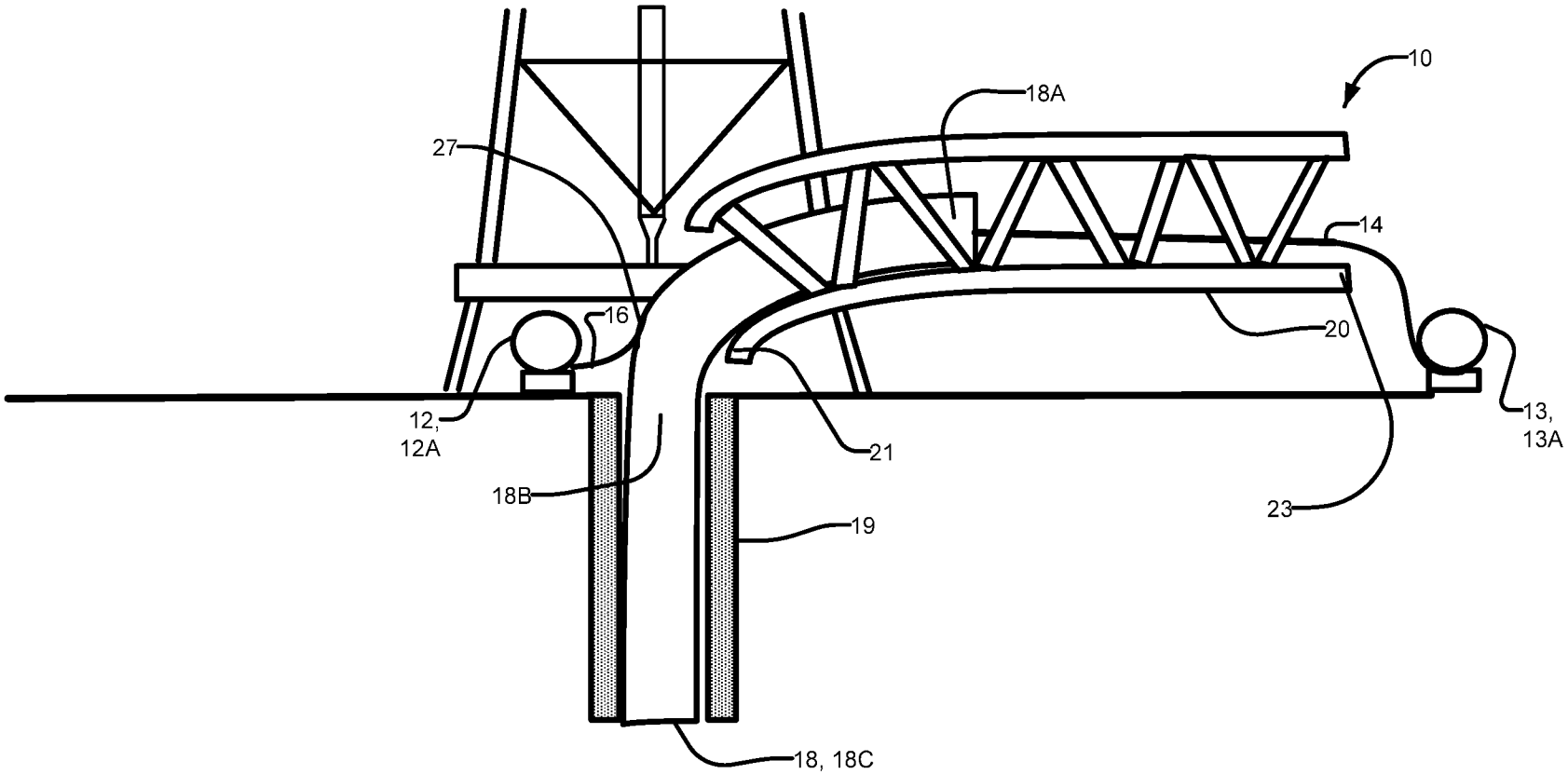
FIG. 1 shows a schematic view of a drilling operation using an apparatus for handling a drill string according to an example embodiment.

FIG. 1 shows an example embodiment of an apparatus 10 for handling a drill string. Drill string 18 has an up-hole end 18A, a mid-section 18B and a down-hole end 18C. As is known in the art, drill string 18 may comprise a plurality of pipe sections (pipes) connected end to end. Mid-section 18B of drill string 18 may be proximate to the effective centre of gravity of drill string 18.

Apparatus 10 comprises a first tension mechanism 13A, such as a winch 13, a second tension mechanism 12A, such as a winch 12, one or more up-hole cable(s) 14 (e.g. one up-hole cable 14 in the illustrated embodiment), one or more down-hole cable(s) 16 (e.g. one down-hole cable 16 in the illustrated embodiment) and a guide 20. For simplicity, the embodiments described herein with one up-hole cable 14 and one down-hole cable 16, it being understood that there may be a plurality of such cables.

The first tension mechanism 13A and the second tension mechanism 12A are winches 12, 13 in the FIG. 1 embodiment, but these tension mechanisms 12A, 13A can be any suitable force-providing mechanisms which can apply tension to drill string 18 via cables 14, 16. Winches 12, 13 may be controlled automatically using tension controls that set a constant or variable tension at the winch.

Up-hole cable 14 is releasably connected to up-hole end 18A of drill string 18 via any suitable releasable connection/attachment mechanism. Winch 13 is operatively connected to up-hole cable 14 to pull drill string 18 up and out from wellbore 19 through guide 20.

Figure 2:
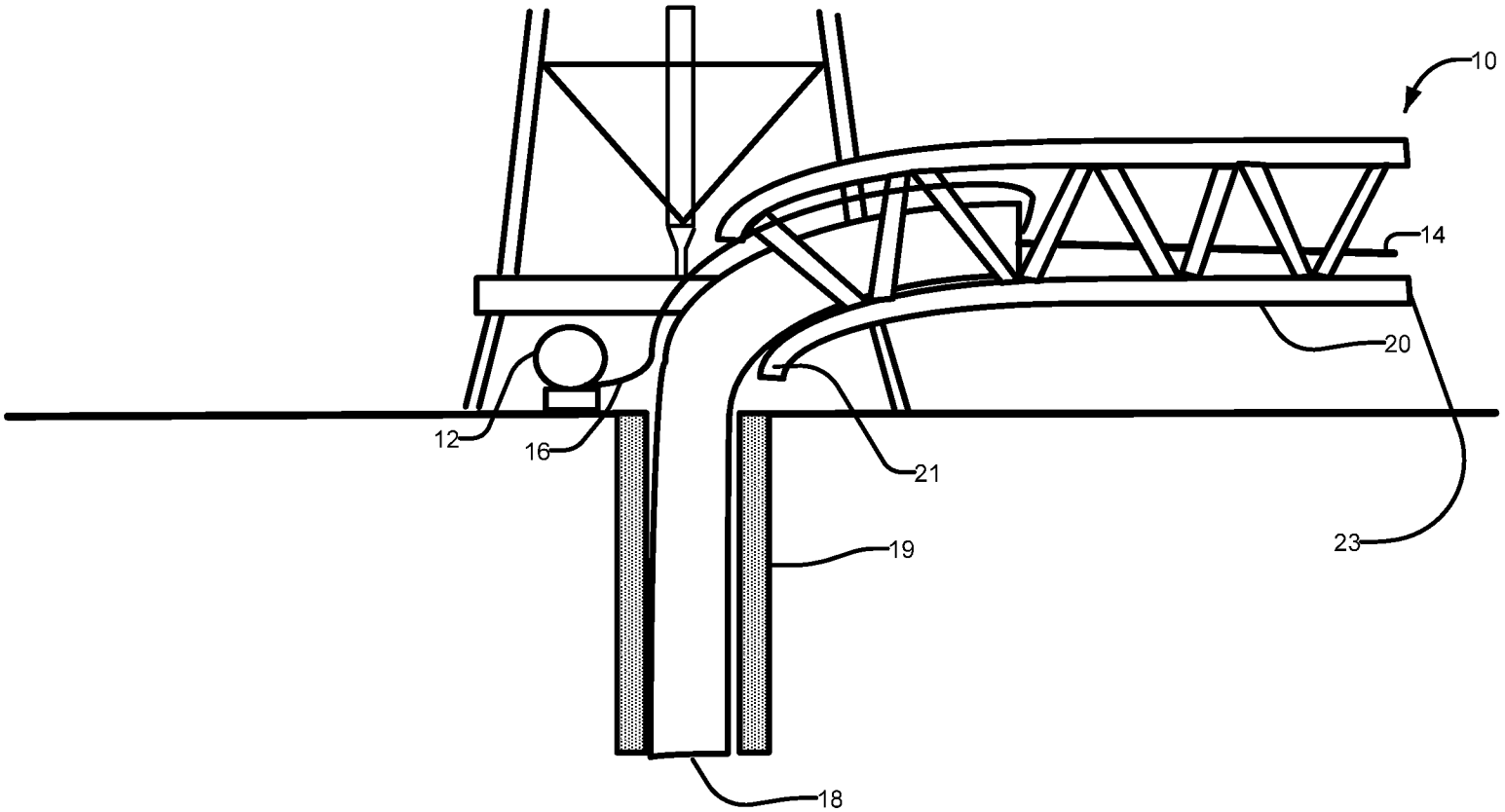
FIG. 2 shows a schematic view of a drilling operation using an apparatus for handling a drill string according to a second example embodiment.

Down-hole cable 16 is releasably connected to a connection location 27 in mid-section 18B of drill string 18 via any suitable releasable connection/attachment mechanism. Additionally or alternatively, as shown in FIG. 2, down-hole cable 16 can also be releasably connected to the up-hole end 18A of drill string 18. Winch 12 is operatively connected to down-hole cable 16 to pull drill string 18 back from guide 20, where drill string 18 can be re-inserted back down into wellbore 19.

Figure 3:
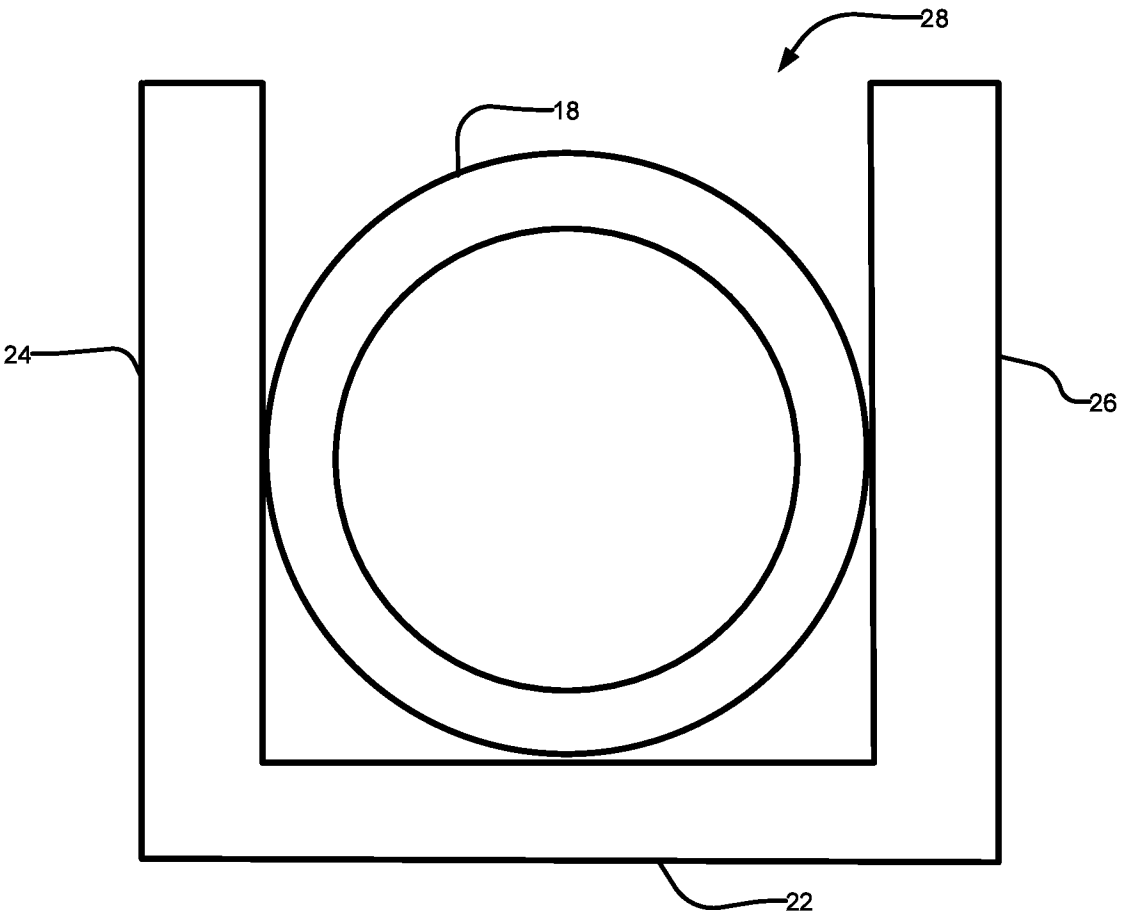
FIG. 3 shows a cross sectional view of a guide according to an example embodiment, wherein the guide is used to support a drill string.

Referring to FIGS. 1-3, guide 20 defines an open channel 28 for receiving drill string 18. Drill string 18 may be pulled upwardly out of wellbore 19 into guide 20 via winch 13 and up-hole cable 14, and may be pulled out of guide 20 for downward reinsertion back into wellbore 19 via winch 12 and down-hole cable 16. Guide 20 has a head end 23 and a tail end 21. Drill string 18 is fed upwardly out of wellbore 19 and into guide 20 through tail end 21 and, as drill string 18 continues to be pulled upwardly out of wellbore 19, drill string 18 may exit guide 20 through head end 23. Guide 20 may be dimensioned to prevent drill string 18 from bending in a manner that is sharper its minimum threshold radius of curvature.

As used in this disclosure and in the accompanying claims, the term "upwardly", unless context dictates otherwise, refers to a direction through guide 20 from tail end 21 toward head end 23. "Upward" movement of drill string 18 through guide 20 corresponds with movement of drill string 18 outwardly from wellbore 19 (i.e. extraction of drill string 18 from wellbore 19). The term "downwardly", unless context dictates otherwise, refers to a direction through guide 20 from head end 23 toward tail end 21. "Downward" movement of drill string 18 through guide 20 corresponds with movement of drill string 18 into wellbore 19 (i.e. insertion of drill string 18 into wellbore 19).

As shown in FIG. 3, guide 20 of the illustrated embodiment comprises a base 22 and two side walls 24, 26. Base 22 and side walls 24, 26 define an open channel 28 (e.g. upwardly opening) for receiving drill string 18. When received in open channel 28, drill string 18 may rest on base 22 (due to gravity) and may be stabilized or otherwise prevented from undesirable transverse movement by side walls 24, 26. Guide 20 may be curved but is shaped to prevent drill string 18 from bending with a radius of curvature that is less than (tighter bend than) a threshold radius of curvature. Controlling this threshold radius of curvature prevents drill string 18 from being damaged when it is supported by guide 20. A person skilled in the art will appreciate that guide 20 can have any number of suitable configurations, as long as guide 20 defines channel 28 through which drill string 18 may be pulled and, optionally, supported and/or constrained.

In some embodiments, base 22 may be equipped with a conveyor system, such as a conveyor belt, a moving floor conveyor system or a pipe lifting mechanism, that assists up-hole cable 14 or down-hole cable 16 to pull drill string 18 through guide 20. In some embodiments, base 22 and/or side walls 24, 26 may be provided with idler rollers or the like (not shown) so that rather than sliding drill string 18 along base 22 as it is pulled through guide 20, drill string 18 may roll along guide 20.

Figure 4A:
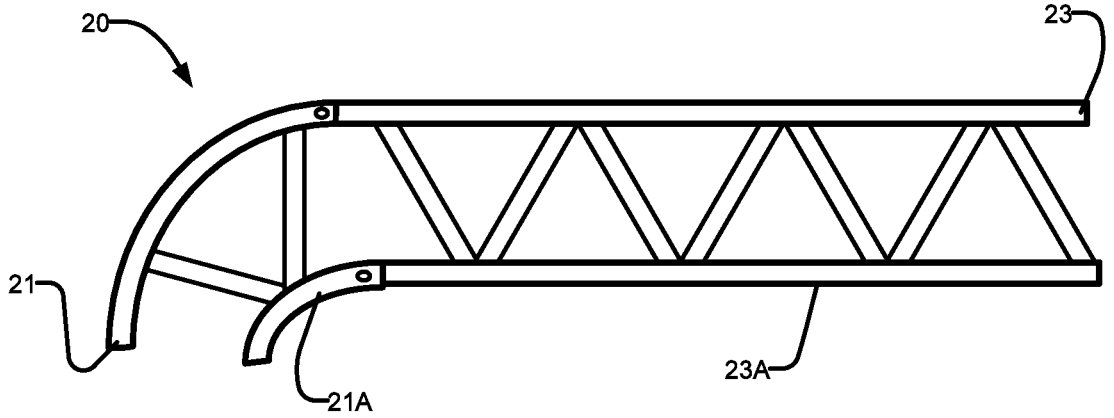
FIG. 4A shows a side elevation view of a guide according to a second example embodiment wherein the guide is in a lowered configuration.
Figure 4B:
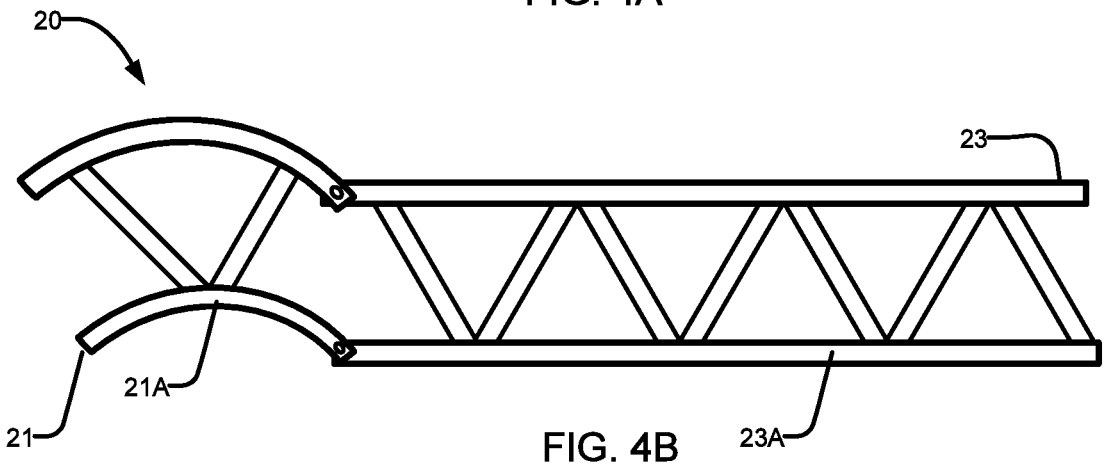
FIG. 4B shows a side elevation view of the embodiment of FIG. 4A wherein the guide is in an raised configuration.

In some embodiments, guide 20 is convertible between a lowered configuration, shown in FIG. 4A, and a raised configuration, shown in FIG. 4B, by suitable movement of tail section 21A including tail end 21 of guide 20 relative to the remainder 23A of guide 20. In the lowered configuration, tail section 21A is moved relative to remainder section 23A to provide a smooth shaped channel, so that up-hole cable 14 can pull drill string 18 upwardly out of wellbore 19 and through guide 20 through the smoothly shaped channel and down-hole cable 16 can pull drill string 18 downwardly through guide 20 through the smoothly shaped channel for insertion into wellbore 19. In the raised configuration, tail section 21A is moved relative to remainder section 23A to introduce a discontinuity into the shape of the channel (as shown in FIG. 4B). This channel-shape discontinuity may prevent drill string 18 from entering into or exiting from guide 20. When guide 20 is not in use, guide 20 can be in the raised configuration, so that guide 20 does not interfere with drilling operations. In other embodiments, tail section 21A is removably coupled to remainder section 23A. In such embodiments, when guide 20 is not in use, tail section 21A may be removed from remainder section 23A.

Figure 5A:
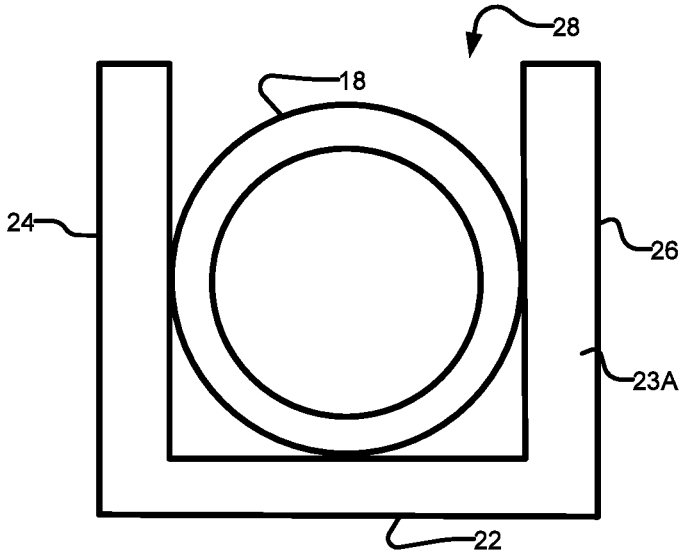
FIG. 5A shows a cross sectional view of a head end of a guide according to a third example embodiment.
Figure 5B:
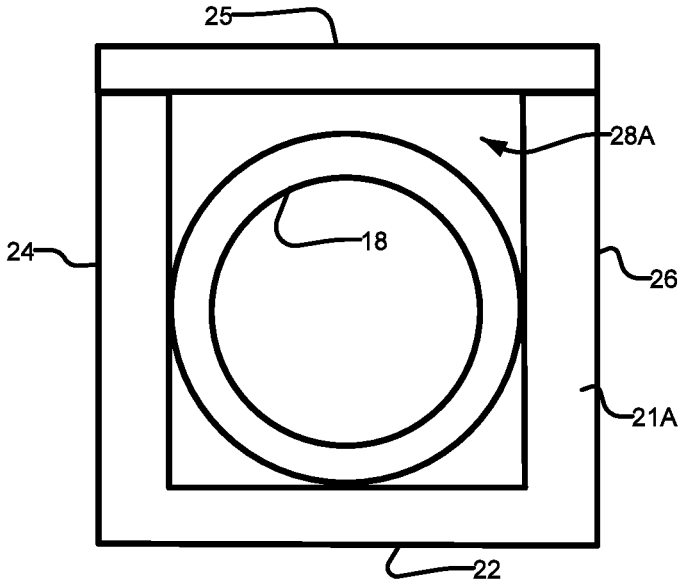
FIG. 5B shows a cross sectional view of a tail end of the FIG. 5A guide.

In some embodiments, guide 20 has an open-shaped channel (e.g. an upwardly opening channel 28) in head section 23A and an enclosed-shaped channel in tail section 21A and/or tail end 21. FIG. 5A shows a cross sectional view of head section 23A of guide 20. Head section 23A has a base 22 and two side walls 24, 26, together defining an open-shaped (e.g. upwardly opening) channel 28 for receiving drill string 18. The open-shaped channel 28 of FIG. 5A surrounds only a portion of a transverse cross-section of drill string 18 located in the elongated channel 28 at the head section 23A. FIG. 5B shows a cross sectional view of tail section 21A of guide 20. Tail section 21A has a base 22, a cover 25 and two side walls 24, 26, together defining an enclosed-shaped channel 28A—i.e. a channel with one or more walls that surround a transverse cross-sectional perimeter of drill string 18 in tail section 21A (or at least a portion thereof). Closed channel 28A prevents drill string 18 from kicking out from guide 20—e.g. once down-hole end 18C of drill string 18 approaches the surface of wellbore 19 or otherwise.

In some embodiments, cover 25 is hingedly joined to one of two side walls 24, 26 or otherwise removably joined to side walls 24, 26, so that cover 25 can pivot relative to side walls 24, 26 (or otherwise be removed from guide 20). Such configuration may help to feed drill string 18 into guide 20 by providing unobstructed access to open channel 28 (e.g. similar to FIG. 5A). For example, when drill string 18 is introduced into guide 20 or when up-hole cable 14 is connected to up-hole end 18A, cover 25 may be pivoted open or removed to provide an upwardly opening channel 28 and thereby help feed drill string 18 into guide 20. After drill string 18 is fed into guide 20, cover 25 may be pivoted closed or connected to side walls 24, 25 to provide closed channel 28A and prevent drill string 18 from kicking out from guide 20.

Figure 6B:
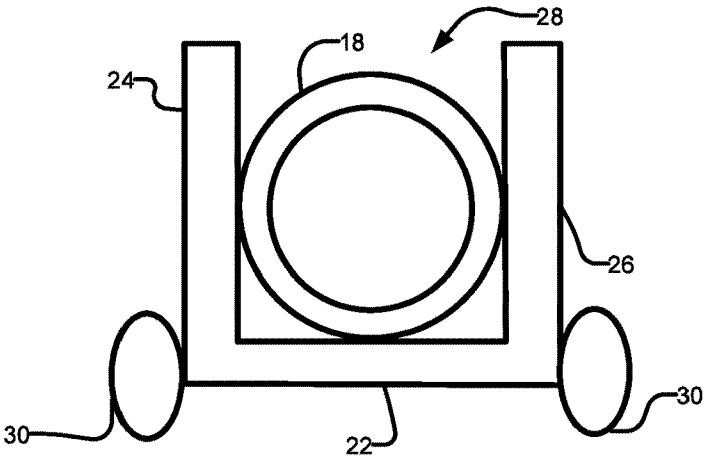
FIG. 6B shows a cross sectional view of the FIG. 6A apparatus.
Figure 6A:
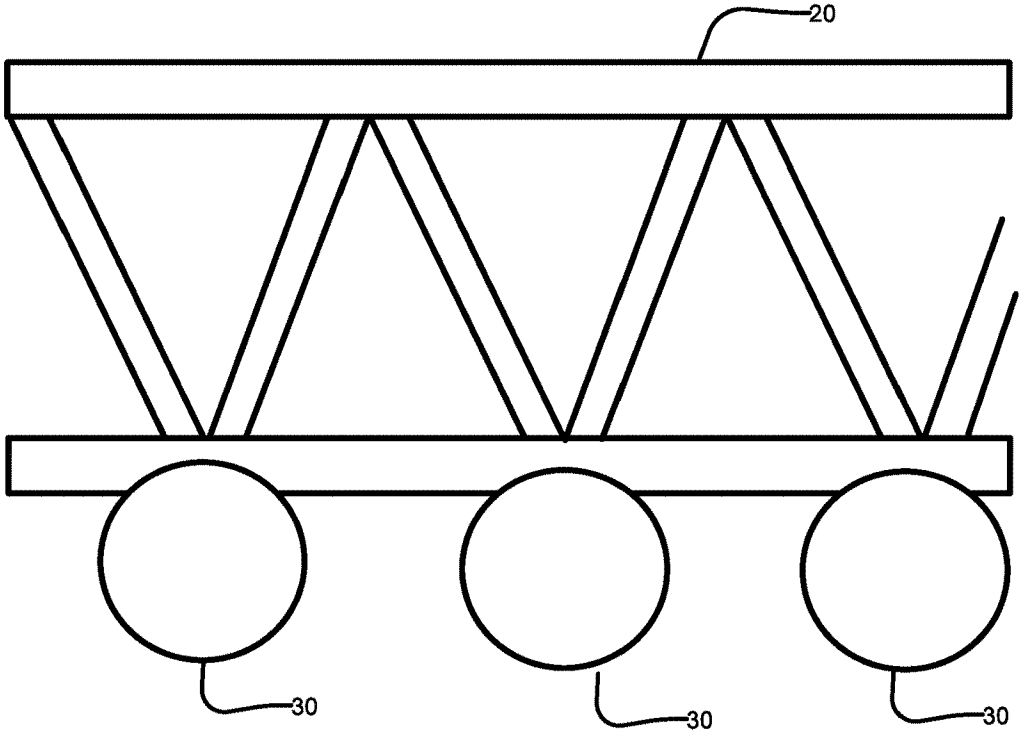
FIG. 6A shows a schematic side elevation view of an apparatus for handling a drill string according to another example embodiment.

In some embodiments, guide 20 is equipped with wheels 30 (as shown schematically in FIGS. 6A and 6B) to improve its mobility.

In some embodiments, apparatus 10 is used with an offshore well (not shown) for pulling a drill string out from a wellbore and lowering the drill string back into the wellbore, with minimal or no disassembly of the drill string.

Figure 7A:
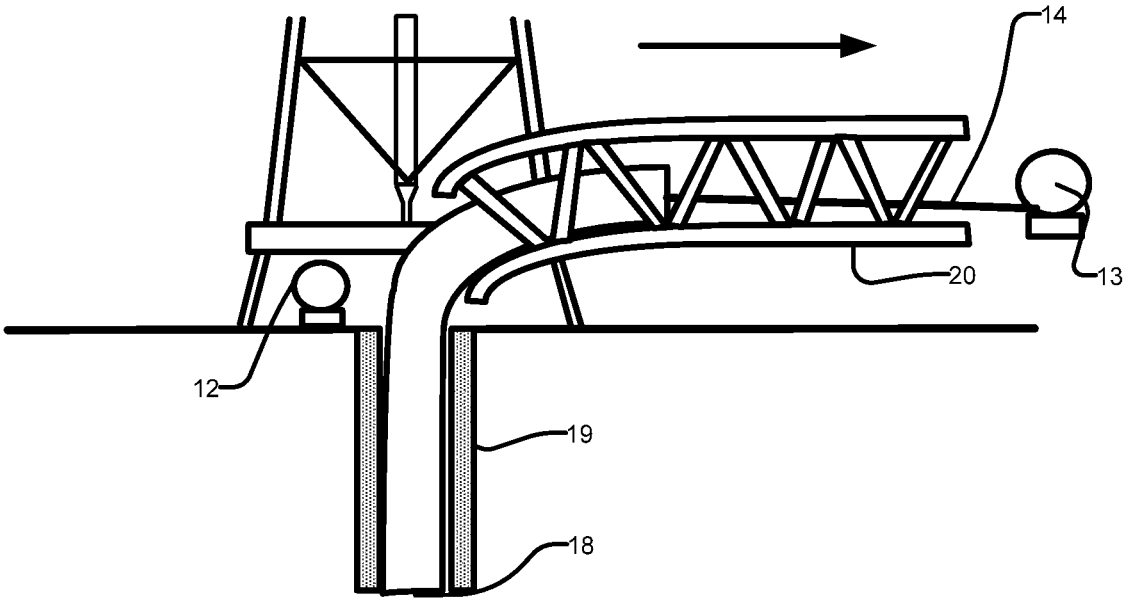
FIGS. 7A-7E show a schematic view of the drill operation wherein the FIG. 1 drill string handling apparatus is used for withdrawing the drill string out from a wellbore and lowering the drill string back into the wellbore.
Figure 7B:
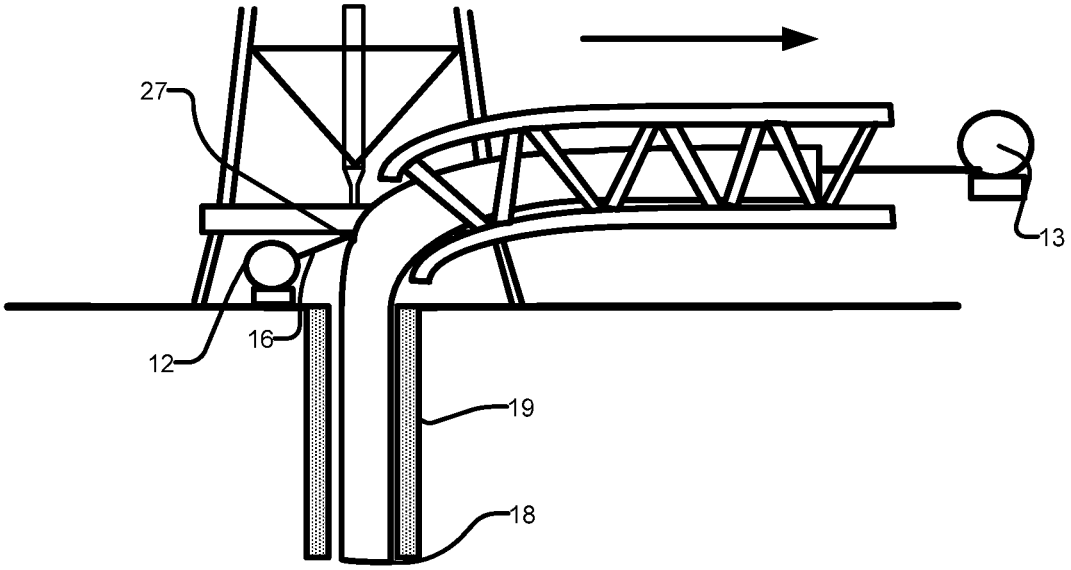

FIGS. 7A-7B show drill string 18 as it is withdrawn (e.g. pulled upwardly out) from wellbore 19. To pull drill string 18 up and out from wellbore 19, up-hole cable 14 is connected to up-hole end 18A of drill string 18. Winch 13 pulls up-hole cable 14 and thereby pulls drill string 18 up and out from wellbore 19, and through channel 28 of guide 20.

When mid-section 18B of drill string 18 is about to enter or has just entered into open channel 28 of guide 20, down-hole cable 16 may be connected to a connection location 27 in mid-section 18B of drill string 18. In other embodiments, down-hole cable 16 is additionally or alternatively connected to up-hole end 18A of drill string 18 when up-hole cable 14 is connected to up-hole end 18A of drill string 18 or when mid-section 18B of drill string 18 is about to enter or has just entered into open channel 28 of guide 20.

Once drill string 18 is removed from wellbore 19, it may be repaired and/or the like. In some embodiments, some sections of side walls 24, 26 may be removed from guide 20 to improve access to drill string in guide 20 to facilitate repair of drill string 18 in situ in guide 20.

Figure 7C:
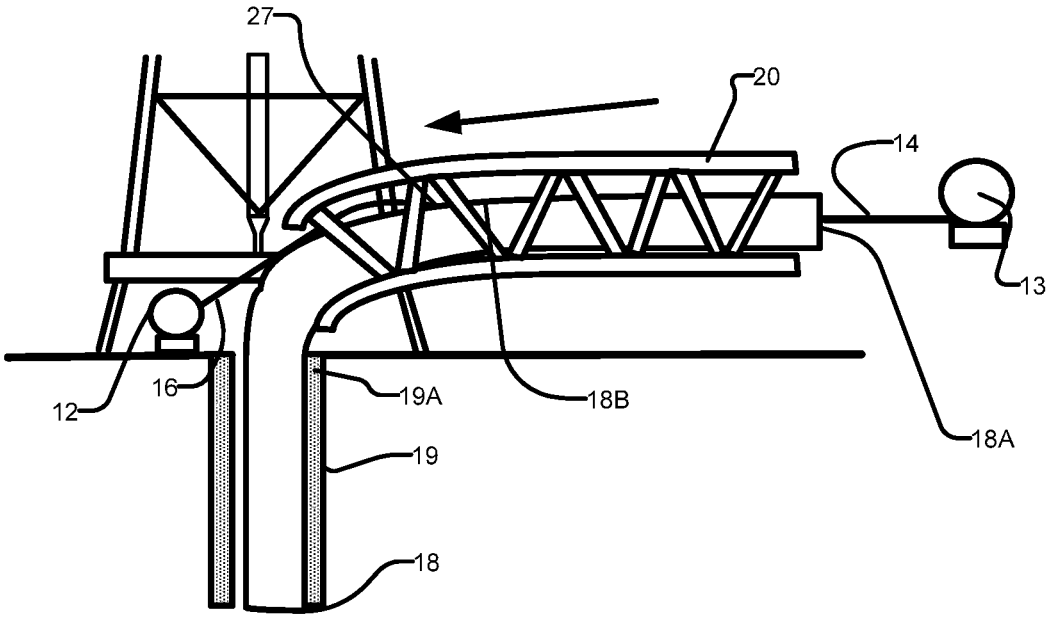
Figure 7D:
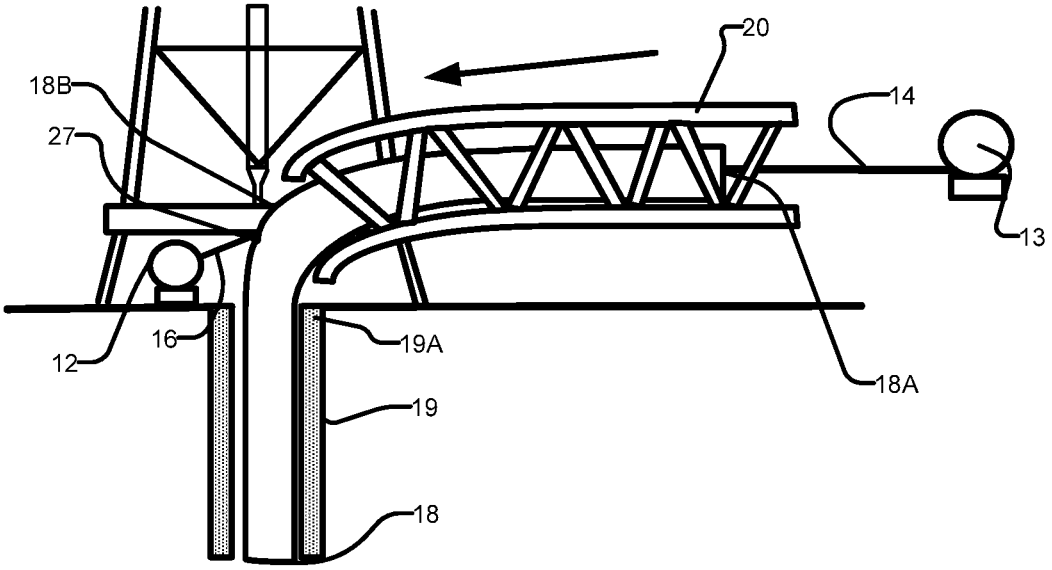
Figure 7E:
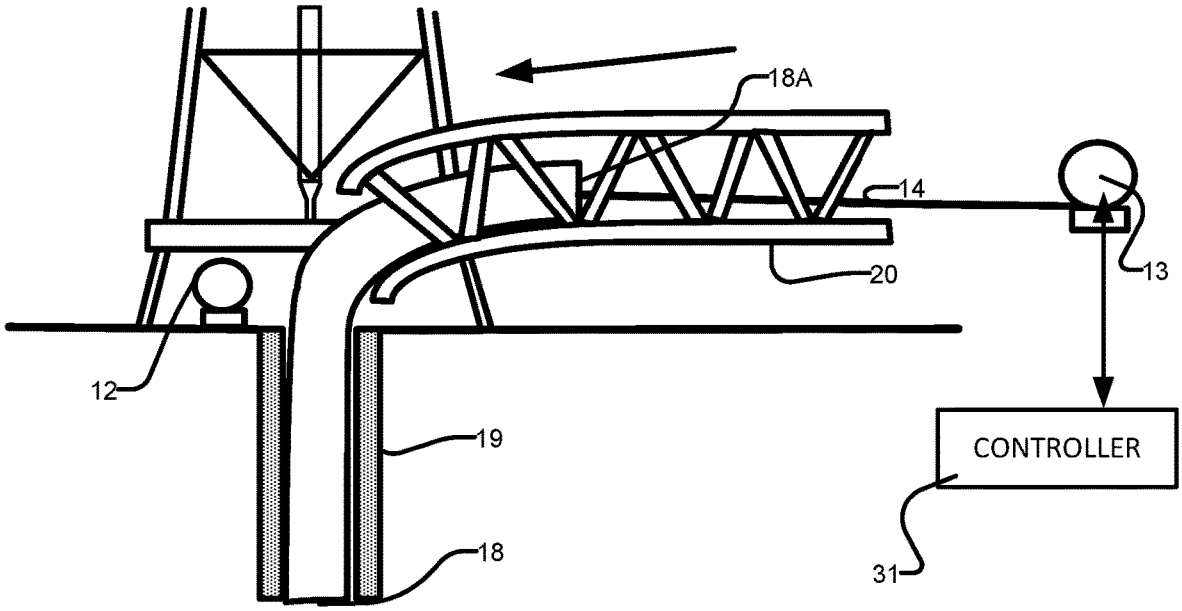

FIGS. 7C-7E show drill string 18 as it is reinserted (e.g. pulled downwardly back from guide 20) into wellbore 19. To return drill string 18 back into wellbore 19, down-hole cable 16 is connected to a connection location 27 in mid-section 18B of drill string 18 (as previously discussed and as shown in FIG. 7C). Down-hole cable 16 may be connected to connection location 27 in mid-section 18B of drill string 18 as drill string 18 is withdrawn from wellbore 19. In some embodiments, down-hole cable 16 may additionally or alternatively be connected to up-hole end 18A of drill string 18. Then, as shown in FIG. 7C, winch 12 pulls down-hole cable 16 and drill string 18 downwardly through guide 20. The rigidity of drill string 18 may cause the down-hole end of drill string 18 to descend into wellbore 19.

As the connection location 27 where down-hole cable 16 is attached to mid-section 18B of drill string 18 approaches winch 12 and/or the upper end 19A of well bore 19 (as shown in FIG. 7D), then gravity may start to pull drill string 18 down into wellbore 19, since the connection location 27 where down-hole cable 16 is attached to mid-section 18B may be at or near the center of gravity of drill string 18. This FIG. 7D configuration may be referred to herein as a release configuration. In the release configuration, at least an up-hole portion of drill string 18 is located in guide 20 and at least a down-hole portion of drill string 18 is located in wellbore 19. In the release configuration, down-hole cable 16 may optionally be disconnected from drill string 18 (as shown in FIG. 7E). At some point, it may not be necessary to further pull drill string 18 downwardly out of guide 20, as gravity will draw drill string 18 downwardly out of guide 20 as drill string 18 extends into wellbore 19.

The release configuration may occur when a length of down-hole cable 16 between second tension mechanism 12 and connection location 27 is a minimum. The release configuration may occur when a force of gravity that tends to pull drill string 18 back into the wellbore 19 becomes greater than frictional forces that tend to hold drill string 18 in guide 20. The release configuration may occur immediately prior to connection location 27 entering wellbore 19.

In the illustrated embodiment, as shown for example in FIG. 7E, up-hole cable 14 remains connected to the up-hole end 18A of drill string 18 and first tension mechanism 13 (via up-hole cable 14) may maintain tension on drill string 18 to prevent drill string 18 from free falling into wellbore 19 by gravity. First tension mechanism 13 via up-hole cable 14 may then lower drill string 18 into wellbore 19. A suitable controller 31 programmed with corresponding control algorithms may be used to control first tension mechanism 13 and to thereby control the rate at which drill string 18 moves downwardly out of guide 20 and into wellbore 19. An operator may also use first tension mechanism 13 to control the rate at which drill string 18 moves downwardly out of guide 20 and into wellbore 19.

In some embodiments, down-hole cable 16 is disconnected from the mid-section 18B of drill string 18 as the mid-section 18B of drill string 18 passes by winch 12. In other embodiments, down-hole cable 16 remains connected to mid-section 18B of drill string 18 as drill string 18 descends into wellbore 19.

In some embodiments, down-hole cable 16 is disconnected from up-hole end 18A of drill string 18 as the mid-section of drill string 18 passes by winch 12. In other embodiments, down-hole cable 16 remains connected to up-hole end 18A of drill string 18 as drill string 18 descends into wellbore 19.

Figure 8:
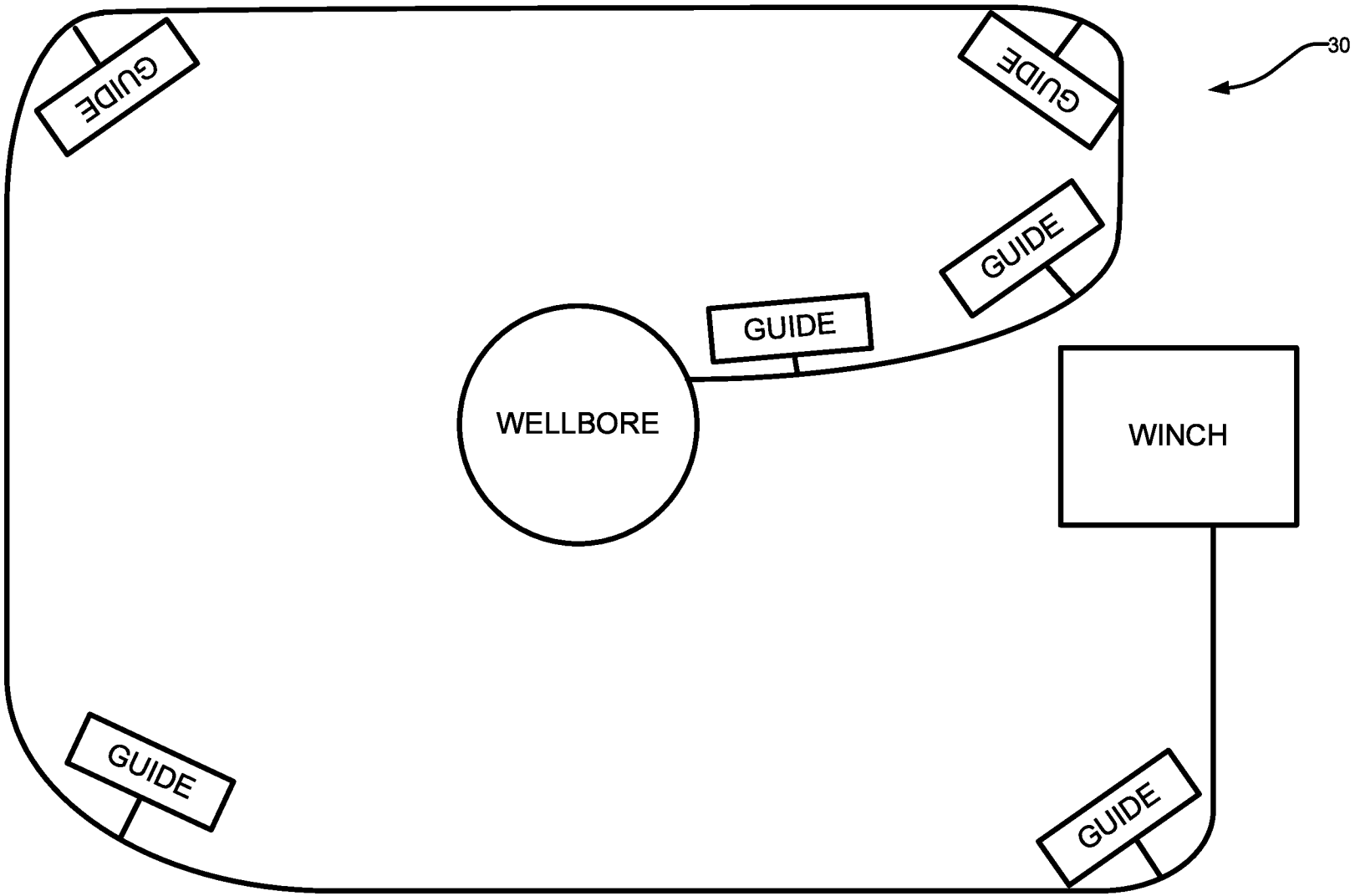
FIG. 8 shows an example path along which the FIG. 1 drill string handling apparatus can guide a drill string.

FIG. 8 shows a path 30 along which the FIG. 1 apparatus 10 can guide drill string 18. With the advent of much deeper wells, correspondingly longer drill strings 18 are often used. Pulling a drill string 18 out from a wellbore 19, without disassembling the drill string 18, may require multiple guides 20 to direct the drill string 18 along a particular path. The particular path can be non-linear. For example, the particular path may be spiral in shape to accommodate limited space situations, e.g. offshore wells. Such a path may require bending of the drill string 18. As such, guides support the drill string 18 and prevent it from being damaged when the drill string 18 is pulled along a curved path.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. An apparatus for handling a drill string having an up-hole end, a mid-section and a down-hole end, the apparatus comprising:

a first tension mechanism;

a second tension mechanism;

an up-hole cable operably connectable between the first tension mechanism and the up-hole end of the drill string;

a down-hole cable operably connectable between the second tension mechanism and a connection location in the mid-section of the drill string; and a guide defining an elongated channel for receiving the drill string;

the guide located relative to the first tension mechanism, the second tension mechanism, the up-hole cable and the down-hole cable so that force applied to the up-hole end of the drill string by the first tension mechanism via the up-hole cable pulls the drill string upwardly through the elongated channel and outwardly from a wellbore and, when the mid-section of the drill string is located in the channel of the guide, force applied to the mid-section of the drill string by the second tension mechanism via the down-hole cable pulls the drill string downwardly through the elongated channel to facilitate at least partial re-insertion of the drill string into the wellbore; and the guide shaped to prevent the drill string from bending, as the drill string is pulled through the elongated channel, in a manner that is sharper than a minimum threshold radius of curvature for the drill string;

wherein the guide comprises:

a tail end through which the drill string enters the guide as the drill string is removed from the wellbore and pulled upwardly into the guide by the first tension mechanism via the up-hole cable; and a corresponding tail section that is relatively more proximate to the tail end than a remainder of the guide; and wherein the tail section is moveable relative to the remainder of the guide between: a lowered configuration where the tail section and the remainder of the guide provide the elongated channel with a smooth shape; and a raised configuration where the tail end introduces a discontinuity into a shape of the elongated channel.

2. An apparatus according to claim 1 wherein the second tension mechanism and the down-hole cable are convertible between:

a connected configuration wherein the second tension mechanism is connected via the down-hole cable to the connection location in the mid-section of the drill sting for application of downward force to pull the drill string downwardly through the elongated channel to facilitate at least partial re-insertion of the drill string into the wellbore; and a release configuration, where at least one of: the second tension mechanism is disconnected from the down-hole cable; and the down-hole cable is disconnected from the drill string; and wherein the second tension mechanism and the down-hole cable are convertible from the connected configuration to the release configuration when at least an up-hole portion of the drill sting is located in the guide and at least a down-hole portion of the drill string is located in the wellbore and wherein gravity facilitates further downward withdrawal of the drill string from the elongated channel and further insertion of the drill string into the wellbore.

3. An apparatus according to claim 2 wherein the second tension mechanism and the down-hole cable are convertible from the connected configuration to the release configuration when a length of the down-hole cable between the second tension mechanism and the connection location is a minimum.

4. An apparatus according to claim 2 wherein the second tension mechanism and the down-hole cable are convertible from the connected configuration to the release configuration when a force of gravity that tends to pull the drill string back into the wellbore becomes greater than frictional forces that tend to hold the drill string in the guide.

5. An apparatus according to claim 2 wherein the second tension mechanism and the down-hole cable are convertible from the connected configuration to the release configuration immediately prior to the connection location entering the wellbore.

6. An apparatus according to claim 2, comprising a controller operatively connected to the first tension mechanism to control an amount of upwardly oriented force exerted on the drill string by the first tension mechanism via the up-hole cable and wherein the controller is configured to control a rate at which the drill string extends back into the wellbore, for at least a portion of the time during which the second tension mechanism and the down-hole cable are in the connected configuration, to thereby prevent the drill string from falling back into the wellbore under the force of gravity.

7. An apparatus according to claim 2, comprising a controller operatively connected to the first tension mechanism to control an amount of upwardly oriented force exerted on the drill string by the first tension mechanism via the up-hole cable and wherein the controller is configured to control a rate at which the drill string extends back into the wellbore when the second tension mechanism and the down-hole cable are in the released configuration to thereby prevent the drill string from falling back into the wellbore under the force of gravity.

8. An apparatus for handling a drill string having an up-hole end, a mid-section and a down-hole end, the apparatus comprising:

a first tension mechanism;

a second tension mechanism;

an up-hole cable operably connectable between the first tension mechanism and the up-hole end of the drill string;

a down-hole cable operably connectable between the second tension mechanism and a connection location in the mid-section of the drill string; and a guide defining an elongated channel for receiving the drill string;

the guide located relative to the first tension mechanism, the second tension mechanism, the up-hole cable and the down-hole cable so that force applied to the up-hole end of the drill string by the first tension mechanism via the up-hole cable pulls the drill string upwardly through the elongated channel and outwardly from a wellbore and, when the mid-section of the drill string is located in the channel of the guide, force applied to the mid-section of the drill string by the second tension mechanism via the down-hole cable pulls the drill string downwardly through the elongated channel to facilitate at least partial re-insertion of the drill string into the wellbore; and the guide shaped to prevent the drill string from bending, as the drill string is pulled through the elongated channel, in a manner that is sharper than a minimum threshold radius of curvature for the drill string;

wherein the guide comprises:

a tail end through which the drill string enters the guide as the drill string is removed from the wellbore and pulled upwardly into the guide by the first tension mechanism via the up-hole cable; and a corresponding tail section that is relatively more proximate to the tail end than a remainder of the guide;

wherein at least a portion of the tail section is shaped to provide the elongated channel with an enclosed shape, the enclosed shape surrounding a transverse cross-section of the drill string located in the elongated channel at the at least a portion of the tail section; and wherein at least a portion of the remainder of the guide is shaped to provide the elongated channel with an open shape, the open shape surrounding only a portion of a transverse cross-section of the drill string located in the elongated channel at the at least a portion of the remainder of the guide wherein the at least a portion of the tail section comprises a moveable cover, the moveable cover moveable between a closed configuration that provides the at least a portion of the tail section with the enclosed shape and an open configuration that provides the at least a portion of the tail section with an open shape which surrounds only a portion of the transverse cross-section of the drill string located in the elongated channel at the at least a portion of the tail section.

9. A method for handling drill string having an up-hole end, a mid-section and a down-hole end, the method comprising:

pulling a drill string out from a wellbore, wherein pulling the drill string out from the wellbore comprises:

connecting an up-hole cable between a first tension mechanism and the up-hole end of the drill string;

pulling the up-hole cable and the drill string upwardly into a guide; and lowering the drill string from the guide back into the wellbore, wherein lowering the drill string from the guide back into the wellbore comprises:

connecting a down-hole cable between a second tension mechanism and a connection location in the mid-section of the drill string;

pulling the down-hole cable and the drill string downwardly out from the guide to facilitate at least partially re-inserting the drill string into the wellbore;

at a release configuration, where at least an up-hole portion of the drill string is located in the guide and at least a down-hole portion of the drill string is located in the wellbore, disconnecting at least one of: the second tension mechanism from the down-hole cable; and the down-hole cable from the drill string; and after the disconnecting, permitting gravity to pull the drill string further downwardly out from the guide to facilitate further re-inserting the drill string into the wellbore;

wherein the guide comprises: a tail end through which the drill string enters the guide as the drill string is pulled upwardly into the guide; and a corresponding tail section that is relatively more proximate to the tail end than a remainder of the guide; and the method comprises moving the tail section relative to the remainder of the guide between: a lowered configuration where the tail section and the remainder of the guide provide an elongated drill-string receiving channel of the guide with a smooth shape; and a raised configuration where the tail end introduces a discontinuity into a shape of the elongated channel.

10. A method according to claim 9 wherein pulling the up-hole cable and the drill string upwardly into the guide comprises pulling at least a portion of the drill string through an elongated channel defined by the guide and wherein the guide is shaped to prevent the drill string from bending, as the drill string is pulled through the elongated channel, in a manner that is sharper than a minimum threshold radius of curvature for the drill string.

11. A method according to claim 9 wherein the release configuration occurs when a length of the down-hole cable between the second tension mechanism and the connection location is a minimum.

12. A method according to claim 9 wherein the release configuration occurs when a force of gravity that tends to pull the drill string back into the wellbore becomes greater than frictional forces that tend to hold the drill string in the guide.

13. A method according to claim 9 wherein the release configuration occurs immediately prior to the connection location entering the wellbore.

14. A method according to claim 9, wherein, for at least a portion of the time during lowering the drill string from the guide back into the wellbore, applying upward force to the up-hole end of the drill string using the first tension mechanism via the up-hole cable, wherein the upward force prevents the drill string from falling back into the wellbore under the force of gravity.

15. A method according to claim 9, wherein, after disconnecting at least one of: the second tension mechanism from the down-hole cable, and the down-hole cable from the drill string, applying upward force to the up-hole end of the drill string using the first tension mechanism via the up-hole cable wherein the upward force prevents the drill string from falling back into the wellbore under the force of gravity.

16. A method according to claim 15 comprising controlling an amount of the upward force exerted on the drill string by the first tension mechanism via the up-hole cable to control a rate at which the drill string extends back into the wellbore.

17. A method for handling drill string having an up-hole end, a mid-section and a down-hole end, the method comprising:

pulling a drill string out from a wellbore, wherein pulling the drill string out from the wellbore comprises:

connecting an up-hole cable between a first tension mechanism and the up-hole end of the drill string;

pulling the up-hole cable and the drill string upwardly into a guide; and lowering the drill string from the guide back into the wellbore, wherein lowering the drill string from the guide back into the wellbore comprises:

connecting a down-hole cable between a second tension mechanism and a connection location in the mid-section of the drill string;

pulling the down-hole cable and the drill string downwardly out from the guide to facilitate at least partially re-inserting the drill string into the wellbore;

at a release configuration, where at least an up-hole portion of the drill string is located in the guide and at least a down-hole portion of the drill string is located in the wellbore, disconnecting at least one of: the second tension mechanism from the down-hole cable; and the down-hole cable from the drill string; and after the disconnecting, permitting gravity to pull the drill string further downwardly out from the guide to facilitate further re-inserting the drill string into the wellbore;

wherein:

the guide comprises: a tail end through which the drill string enters the guide as the drill string is pulled upwardly into the guide; and a corresponding tail section that is relatively more proximate to the tail end than a remainder of the guide;

at least a portion of the tail section is shaped to provide the elongated channel with an enclosed shape, the enclosed shape surrounding a transverse cross-section of the drill string located in the elongated channel at the at least a portion of the tail section; and at least a portion of the remainder of the guide is shaped to provide the elongated channel with an open shape, the open shape surrounding only a portion of a transverse cross-section of the drill string located in the elongated channel at the at least a portion of the remainder of the guide.

18. A method according to claim 17 wherein the at least a portion of the tail section comprises a moveable cover and the method comprises moving the moveable cover between a closed configuration that provides the at least a portion of the tail section with the enclosed shape and an open configuration that provides the at least a portion of the tail section with an open shape which surrounds only a portion of the transverse cross-section of the drill string located in the elongated channel at the at least a portion of the tail section.

* * * * *